United States Patent [19]

Hatcher et al.

[11] Patent Number: 4,605,351

[45] Date of Patent: Aug. 12, 1986

[54] CLOSURE LINING MACHINE

[75] Inventors: Clive D. Hatcher, Marlow Bottom; Alan Hill, Stanmore; Geoffrey W. King, Northolt, all of England

[73] Assignee: W. R. Grace & Co., Lexington, Mass.

[21] Appl. No.: 671,550

[22] Filed: Nov. 15, 1984

[51] Int. Cl.[4] ..... B21D 51/46

[52] U.S. Cl. ..... 413/58; 413/9

[58] Field of Search ..... 413/8, 9, 57–61

[56] References Cited

U.S. PATENT DOCUMENTS

| | | | |
|---|---|---|---|
| 1,908,898 | 5/1933 | Johnson | 413/58 |
| 2,915,029 | 12/1959 | Hohl et al. | 413/9 |
| 4,048,886 | 9/1977 | Zettler | 72/26 |

FOREIGN PATENT DOCUMENTS 1222317 4/1969 United Kingdom .

OTHER PUBLICATIONS

W. R. Grace, Ltd., UNILINER, The Electronic Approach to Closure Lining, Feb. 1984, U.K., Sales Brochure.

*Primary Examiner*—Leon Gilden

*Attorney, Agent, or Firm*—John Dana Hubbard; Stacey L. Channing; William L. Baker

[57] ABSTRACT

A closure lining machine comprises a lining applicator 7, a star wheel 4 to receive a closure to be lined and move it to the lining applicator and thence to an outlet 8. The machine also includes a stepping motor 9 driving the star wheel 4, and a control circuit including variable means 17, variable in dependence upon the number of pockets 3 in the star wheel 4. The control circuit controls the stepping motor 9 and hence the movement of the star wheel 4 and also controls the operation of the lining applicator 7 so that upon changing the star wheel 4 to accommodate a different size of closure the control of the rotation of the star wheel 4 and the application of the lining is controlled by the control circuit in response to a change in the signal from the variable means 17.

11 Claims, 4 Drawing Figures

CLOSURE LINING MACHINE

This invention is concerned with a machine for lining closures. Closures come in a very wide range from the ends of cans and drums, which form the end face of a closed can or drum; lids, screw caps and crown caps for closing bottles, jars and other containers; and, also embrace tearable closures. All of these different types of closures include some form of lining to improve the seal between the closure and the remainder of the container. The lining may be annular around the portion of the closure which engages the remainder of the container or, alternatively, the lining may be continuous over the entire inner surface of the closure so that it not only improves the seal between the remainder of the container and the closure but also acts as a barrier to prevent contact between the contents of the container and the material forming the closure. The lining is usually applied as a lining compound which may be a plastisol, water based or solvent based, may be a compound applied as a hot molten composition which subsequently solidifies or may be formed by adhesives. Additionally the lining may be formed by a moulding process.

In view of the wide variety of different closures and different forms of lining that may be used on each closure, there are, at present, a wide variety of machines in use for lining such closures. In general, each lining machine is arranged to line a particular closure, or a particular group of closures of similar size with one particular type of lining. Thus, typically, a machine for lining crown caps will typically only be capable of lining crown caps and a machine for applying an annular lining to a screw cap will typically only be capable of applying an annular lining to screw caps of, for example, three or four different, but similar sizes. However, all such closure lining machines include a fence and star wheel to feed closures one at a time, and a lining composition applicator. The closures to be lined are fed into pockets of the star wheel and then moved by rotation of the star wheel between the star wheel and the fence until they are adjacent the lining composition applicator. The closures are then lined. Subsequent rotation of the star wheel moves the lined closures away from the lining composition applicator and towards a discharge outlet. Naturally, depending upon the type of lining, the machines may also include a chuck to rotate the closure, for example to rotate the closure whilst a lining composition is applied to form an annular lining, or for example, to spin the closure rapidly to spread a lining composition over the entire surface of the closure to form a continuous lining over the inside surface of the closure. Naturally, where a moulded lining is to be produced a die is lowered onto the closure after a lining composition has been applied to it to mould the lining composition into the required configuration.

In all existing closure lining machines, the entire machine is driven mechanically from a single electric motor using a series of gears, links, levers and cams. This ensures that, once the machine has been set up, its various operations continue to run in synchronism. However, where the machine is capable of handling more than one size of closure, it is necessary, after changing the star wheel for one of different pitch to accommodate closures of different size, to adjust the length of the various levers and operation positions of some of the cams to retime completely its indexing drive system so that it operates correctly with the different size or pitch of star wheel. Naturally, this is difficult to change and requires a skilled operator to retime the whole machine.

According to this invention a closure lining machine comprising a lining applicator, a star wheel to receive a closure to be lined and move it to the lining applicator and thence to an outlet, also includes a stepping motor driving the star wheel, and a control circuit including variable means, variable in dependence upon the number of pockets in the star wheel, the control circuit controlling the stepping motor and hence the movement of the star wheel and also controlling the operation of the lining applicator so that upon changing the star wheel to accommodate a different size of closure the control of the rotation of the star wheel and the application of the lining is controlled by the control circuit in response to a change in the signal from the variable means.

Preferably the lining applicator includes an applicator to apply a lining composition and also includes a chuck located beneath the lining composition applicator, a drive motor to rotate the chuck, and an angular position encoder connected to the chuck or to the motor to output signals corresponding to the angular position of the chuck. Preferably the motor is also driven by the control circuit in response to the output from the angular position encoder and in this way, the control circuit can rotate the closure through one or more complete revolutions whilst the lining composition applicator is applying lining composition to the closure to create an annular lining. Alternatively, the motor may spin the closure after a lining composition has been applied by the applicator to spread the lining composition over the closure. The chuck may also include means to lift and lower it to lift the closure out of its pocket in the star wheel and move it towards the lining applicator. In this case these means are preferably formed by a double acting pneumatic ram the operation of which is preferably also controlled by the control circuit.

The machine may include a closure detector located downstream from the inlet for closures to be lined to ensure that the lining applicator only operates when the closure is located beneath it. This ensures that lining composition is not supplied in the absence of a closure. The supply of the composition in the absence of a closure contaminates and tends to clog up the operation of the entire machine.

Thus, the operation of the machine in accordance with this invention can be readily and easily controlled to provide any type of composition lining in a closure of any outer diameter. Thus, it is possible simply by providing a number of different star wheels each having a different number of pockets of different size around its periphery, and, where necessary, a different fence, to enable a single machine to apply a variety of different linings to a wide variety of different types and sizes of closure without requiring any skilled resetting and retiming of the machine between the different types of closure.

The star wheels may include some form of identification which automatically changes the variable means to provide the appropriate output signal but preferably the variable means is formed by an array of thumb wheel switches which are simply set by the operator to correspond to the number of pockets in the periphery of the star wheel.

It is also possible to increase the speed of the machine still further by having two, or possibly more, lining applicators and arranging for two unlined closures to be introduced into pockets of the star wheel, lined, and discharged, in each cycle. Naturally, in this case, and machine preferably includes two or more chucks and cap detectors.

A particular example of a closure lining machine in accordance with this invention will now be described with reference to the accompanying drawings in which.

Figure 1:
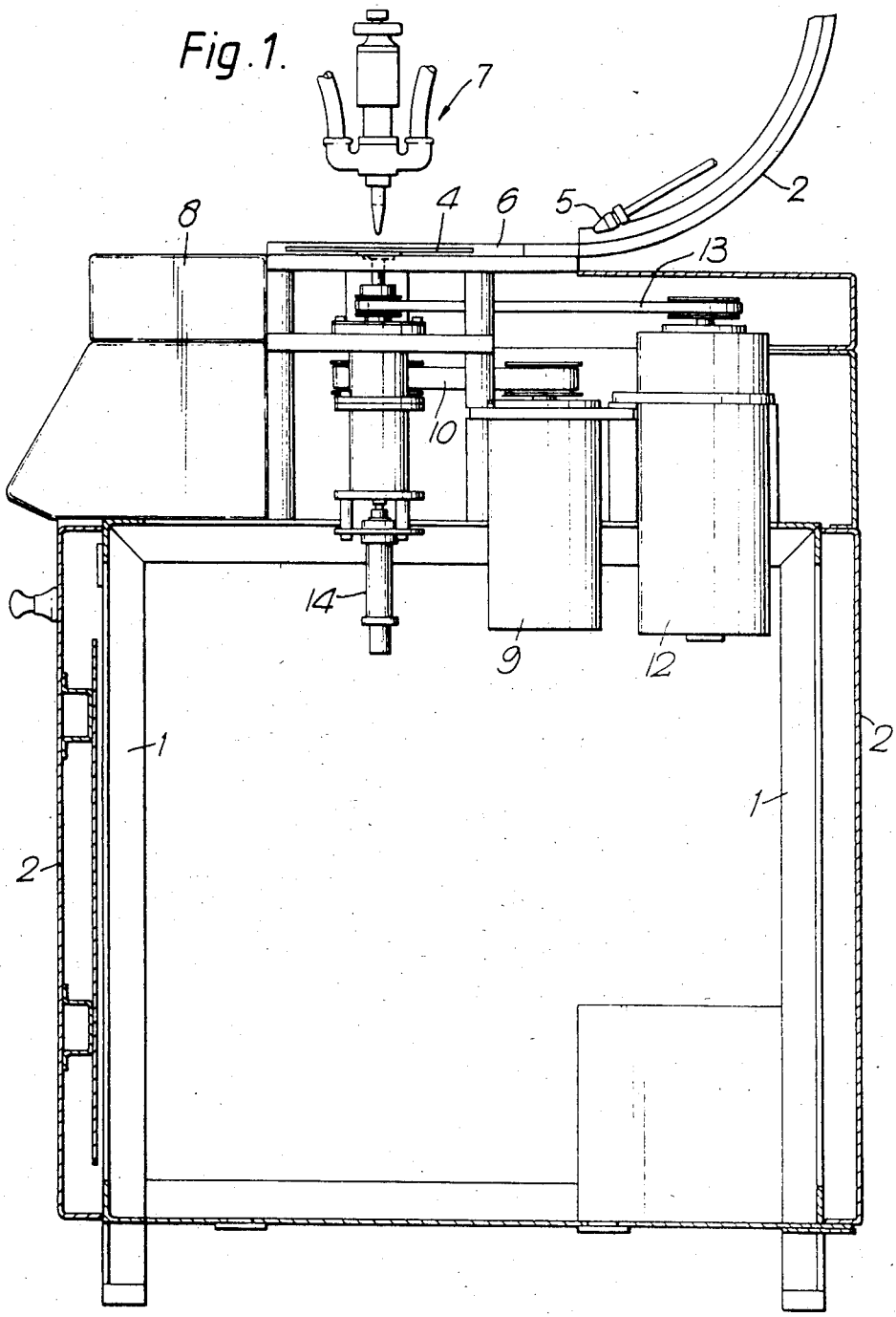
FIG. 1 is a side elevation of the machine.
Figure 2:
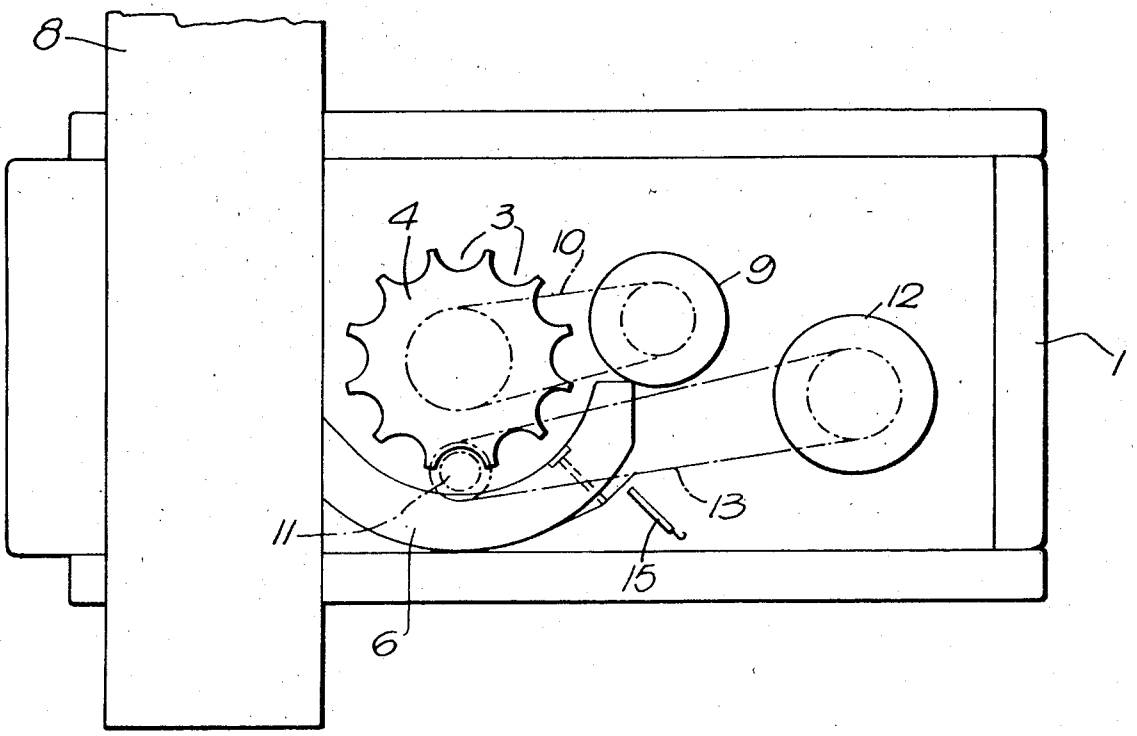
FIG. 2 is a plan of the machine.

The closure lining machine comprises a main frame 1 surrounded by a housing. Closures to be lined are fed from a hopper (not shown) through a delivery chute 2. Typically, the closures are urged into pockets 3 in a star wheel 4 by an air jet from a nozzle 5. Upon rotation of the star wheel 4 the closures are channelled between the star wheel 4 and a curved fence 6, fed past a lining composition applicator gun 7 and then discharged via a discharge conveyor 8. The star wheel 4 is driven by an electrical stepping motor 9 via a toothed belt 10. A rotatable chuck 11 located immediately beneath the lining composition applicator gun 7 is driven by a DC motor 12 via a second toothed belt 13. The chuck 11 is movable upwards and downwards by a double acting pneumatic ram 14. The machine also includes a closure detector 15 to detect the presence of a closure in one of the pockets 3 of the star wheel 4 downstream from the chute 2.

Figure 3:
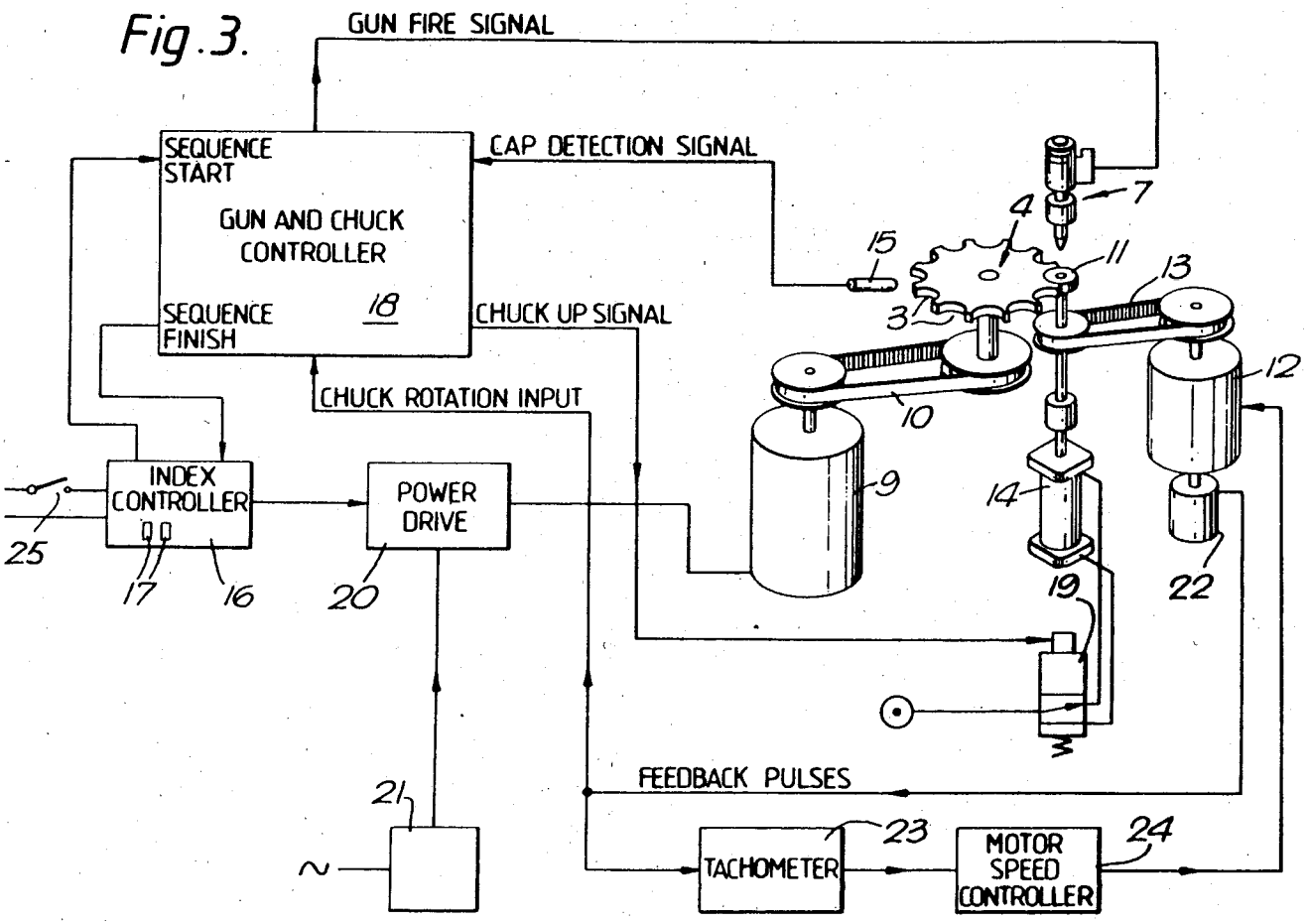
FIG. 3 is a block diagram of the essential parts of the machine together with the control circuit; and, FIG. 4 is a block diagram of the gun and chuck controller.

The closure lining machine also includes a control circuit shown in FIG. 3. The control circuit includes an index controller 16 such as model No. 1041 manufactured by Digiplan of Poole, Dorset, United Kingdom. This index controller 16 include a number of thumb wheel switches 17. The operator sets the thumb wheel switches 17 to give a numbered read out corresponding to the number of pockets in the star wheel 4. The control circuit also includes a gun and chuck controller 18 which controls a solenoid operated pneumatic valve 19 for operating the pneumatic ram 14 and controls the operation of the lining composition applicator gun 7. The controller 18 is shown in more detail in FIG. 4 and is typically a controller such as model No. CPT 23 manufactured by Tristem of Warley, West Midlands, United Kingdom. The control circuit further includes a power drive 20 connected between a power supply 21 and the index controller 16, and the stepper motor 9. The power drive is typically model no. 1073 and the power supply may be model no. TO33, both made by Digiplan of Poole, Dorset, United Kingdom when the stepper motor 9 is a type FET2 size 34 made by Evershed & Vignoles of Acton, London, United Kingdom.

The DC motor 12 is preferably a 0.25 kW model no. MD7175 made by the General Electric Company (Small Drives Division) of Warley, West Midlands, United Kingdom, and has attached to it an angular position encoder or digitiser 22 such as model no. 1341 made by Ralcom of Pangbourne, Oxfordshire, United Kingdom, which is linked to the controller 18 and via a feed back loop to a tachometer 23 and motor speed controller 24 which drives the motor 12. The tachometer 23 typically is a model 2917: 302-047 made by RS Components of London EC2, United Kingdom and the motor speed controller 24 is model no. CIM made by Anyspeed of Telford, West Midlands, United Kingdom.

At the start of each operation sequence, a start switch 25 is closed to give a signal to the index controller 16 and from this to the gun and chuck controller 18. The sequence start signal is applied to a chuck lift control 26 and through this to the pneumatic control valve 19 to cause the pneumatic ram 14 to lift the chuck 11. The sequence start signal is also applied through a detector memory 27 and a gun variable delay circuit 28 to a selector switch 29. The detector memory 27 is enabled by a signal from the cap detector 15 during a previous sequence when the pocket 3 in the star wheel 4 now beneath the composition applicator gun 7 was adjacent the cap detector 15. Thus, in the absence of a cap from the pocket 3 the detector memory 27 inhibits the triggering of the composition applicator gun 7. The variable gun delay 28 allows time for the chuck 11 to be raised by the pneumatic ram 14. The selector switch 29 enables an overall lining or an annular lining to be selected for the cap. The selector switch applies the output from the delay 28 to a variable gun open delay circuit 30 or variable gun open timing circuit 31, depending upon the setting of the switch 29.

Figure 4:
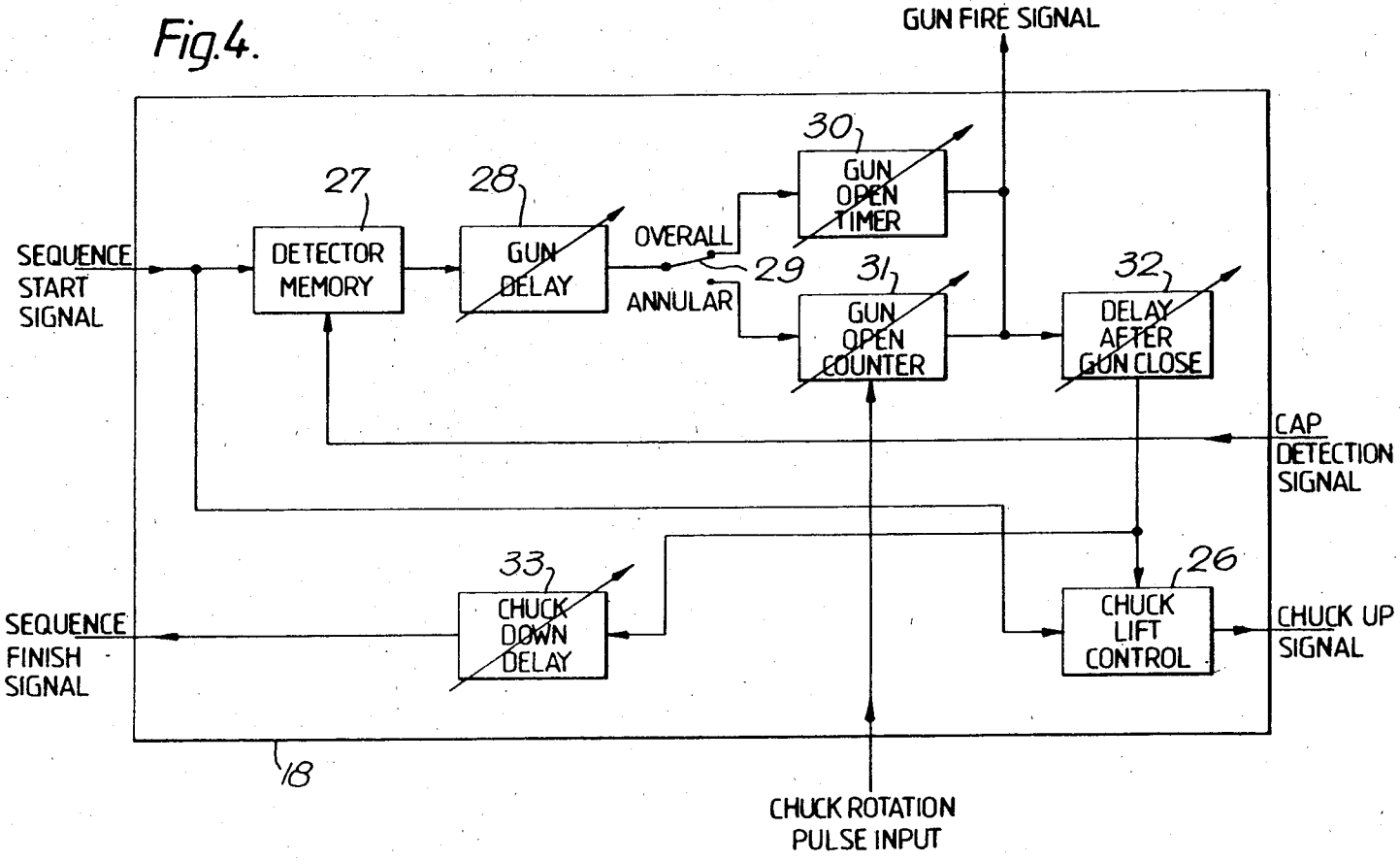

Assuming selector switch is in the position shown in FIG. 4 and an overall lining of the closure is required a gun fire signal is output from the delay circuit 30 to hold the gun 7 open for a predetermined period of time to apply a predetermined quantity of lining composition onto the closure on the chuck 11. The gun 7 is preferably arranged to discharge the composition into the centre of the closure. As the chuck 11 is lifted by the pneumatic ram 14 the motor 12 is actuated to spin the closure on the chuck 11. Another delay circuit 32 provides a variable delay after the applicator gun 7 is closed to allow for the composition tail from the applicator gun 7 to be broken and for the lining composition to be spun out over the entire inside surface of the closure. Upon completion of this delay an output is fed from the delay circuit 32 to the chuck lift control 26 which causes the valve 19 to be de-actuated and the ram 14 to lower the chuck 11. The output from the delay circuit 32 is also fed to a further variable delay circuit 33, to provide a delay to allow the chuck time to be lowered before a sequence finish signal is given to the index controller 16.

Upon receipt of the sequence finish signal the index controller 16 sends a pattern of programmed motion pulses to index the power drive 20 in accordance with the setting of the thumb wheel switches 17 and the power drive 20 provides a drive signal to the stepping motor 9 to cause the stepping motor 9 to turn the star wheel 4 through a predetermined angle of rotation sufficient to move the star wheel 4 around by exactly the pitch between the pockets 3, taking into account the mechanical ratio of the toothed belt drive 10, so that the next closure to be lined is moved beneath the applicator gun 7. When the star wheel 4 stops moving, the index controller 16 initiates the next composition application sequence by sending a sequence start signal to the gun and chuck controller 18. The composition application sequence is then repeated and the above series of operations repeated for each closure to be lined.

To provide an annular lining on a closure the selector switch 29 is moved to connect the gun delay circuit 28 to the gun open counter circuit 31. The closures to be lined are fed into the pockets 3 of the star wheel 4 and the star wheel 4 is indexed around by the index controller 16 and stepper motor 9 as already explained. When the star wheel 4 stops moving and the index controller 16 sends a sequence start signal to the gun and chuck controller 18 this is fed to the chuck lift control 26 and the detector memory 27 as previously. If a closure is present the signal is fed through the gun delay circuit 28 to allow time for the chuck 11 to be raised by the ram 14 to bring the closure into position adjacent the applicator gun 7. The motor 12 is rotating to rotate the chuck 11 as it is lifted. The position encoder 22 associated with the motor 12 provides a feedback signal via the tachometer 23 to the motor speed controller 24. The motor speed controller 24 compares this fedback signal with a preset speed and varies its output to the motor 12 to maintain a constant rotational speed of the chuck 11.

The output from the gun delay circuit 28 triggers the counter 31 to open the gun to start the application of the lining composition to the closure. In this case the gun is arranged to discharge the lining composition adjacent the periphery of the closure. The output from the angular position encoder 22 is also fed to the gun open counter 31 in the gun and chuck controller 18. After a predetermined count has been incremented in the counter 31, the count corresponding to one whole revolution of the chuck 11, the application of the lining composition is stopped and an output signal is fed to the delay circuit 32. This delay circuit 32 allows the tail of the composition between the applicator gun 7 and the closure time to break. At the end of the delay 32 an output signal is fed to the chuck lift control 26 and to the delay 33 and this lowers the chuck 11 and provides the finish sequence signal which initiates the index controller 16 to move the star wheel 4 by an amount equal to the pitch between adjacent pockets 3 of the star wheel 4. The cycle is then repeated.

We claim:

1. A closure lining machine comprising a star wheel having one or more pockets in its outer peripherial edge to receive a closure to be lined and move it to a lining applicator and thence to an outlet, the lining applicator being located above the star wheel and in alignment with the closure in a pocket of the star wheel to apply a lining compound to the closure, the star wheel being driven by a stepping motor and a control circuit including a variable means, variable in dependence upon the number of pockets in the star wheel, the control circuit controlling the stepping motor and hence movement of the star wheel and also controlling operation of the lining applicator so that upon changing the star wheel to accommodate a different size of closure the control circuit is varied to synchronize the movement of the star wheel and the operation of the lining applicator to the different sizes of closure.

2. A closure lining machine according to claim 1, further comprising a chuck located beneath the lining applicator in alignment with the closure in the pocket of the star wheel to be lined and capable of rotating the closure to be lined, the chuck having a drive motor to rotate the chuck.

3. A closure lining machine according to claim 2, which also includes an angular position encoder connected to the chuck or to the drive motor to output signals corresponding to the angular position of the chuck, the motor also being driven by the control circuit in response to the output from the angular position encoder through one complete revolution whilst the lining composition applicator is applying lining composition to the closure to create an annular lining.

4. A closure lining machine according to claim 2, in which means are included to lift and lower the chuck to lift the closure out of its pocket in the star wheel and move it towards the lining applicator.

5. A closure lining machine according to claim 3, in which means are included to lift and lower the chuck to lift the closure out of its pocket in the star wheel and move it towards the lining applicator.

6. A closure lining machine according to claim 4, in which the means are preferably formed by a double acting pneumatic ram the operation of which is also controlled by the control circuit.

7. A closure lining machine according to claim 5, in which the means are preferably formed by a double acting pneumatic ram the operation of which is also controlled by the control circuit.

8. A closure lining machine according to claim 1, which includes a closure detector located downstream from an inlet for closures to be lined to ensure that the lining applicator only operates when a closure is located beneath it.

9. A closure lining machine according to claim 1, in which the variable means includes an array of thumb wheel switches which are set by an operator to correspond to the number of pockets in the periphery of the star wheel.

10. A closure lining machine comprising a main frame having a star wheel to receive a closure to be lined, the star wheel having one or more pockets to hold the closures to be lined, and having a stepping motor to drive the star wheel, a curved fence adjacent the star wheel and forming a channel with the star wheel through which the closures in the one or more pockets of the star wheel are rotated, a lining applicator attached to the main frame and positioned above the channel and aligned with a center of one of the pockets of the star wheel, a rotatable chuck, located beneath the lining applicator of the star wheel, the chuck having a drive means to rotate the chuck and a means to lift and lower the chuck, an outlet downstream of the channel for removing the lined closures, and a control circuit for synchronizing the lining machine, the control circuit connected to the stepping motor and the lining applicator to synchronize their movements, the control circuit connected to the check through an angular encoder which outputs a signal to the control circuit corresponding to an angular position of the chuck, a feedback means from the control circuit to the chuck to control the chuck in response to the output signal of the angular encoder, the control circuit having a variable means comprising one or more thumb set switches mounted on the mainframe and the synchronization of the lining machine is varied by a movement of the one or more thumb set switches to correspond to the number of pockets in the star wheel so as to provide proper synchronization of the lining machine with star wheels having a varying number of pockets.

11. A closure lining machine comprising a mainframe having an upper substantially planar surface; a chute having a first end attached to an end of the upper planar surface of the mainframe and a second end attached to a hopper containing unlined closures; a star wheel centered on the upper planar surface having one or more pockets in its outer periphery, and being in alignment with the first end of the chute; a curved fence adjacent the star wheel and substantially perpendicular to the first end of the chute to form a channel with the star wheel; a nozzle adjacent the first end of the chute for aligning the closures into the one or more pockets of the star wheel; a lining applicator mounted to the mainframe and positioned above the channel and centered over a closure in the pocket of the star wheel; a rotatable chuck, capable of being raised and lowered, positioned immediately below the lining applicator and the pocket of the star wheel containing the closure to be lined; a discharge conveyor attached to the mainframe downstream from the star wheel and lining applicator and adjacent an end of the channel for removing lined closures; and a control circuit having a series of interdependent controllers for synchronizing movements of the star wheel and lining applicator and having one or more thumb set switches mounted to a side of the mainframe to vary the range and timing of the movements of the star wheel and lining applicator, the range and timing being varied upon the number of pockets contained in the star wheel.

* * * * *